United States Patent [19]

Limoni

[11] 4,215,655

[45] Aug. 5, 1980

[54] CRESCENT HEAT EXCHANGER LIQUID HEATER

[76] Inventor: Uri Limoni, 9 Huckelberry La., Oyster Bay, N.Y. 11771

[21] Appl. No.: 947,845

[22] Filed: Oct. 2, 1978

[51] Int. Cl.[3] ..... F22B 7/00

[52] U.S. Cl. ..... 122/136 R; 122/149

[58] Field of Search ..... 122/136 R, 149, DIG. 16

[56] References Cited

U.S. PATENT DOCUMENTS

| | | | |
|---|---|---|---|
| 1,669,720 | 5/1928 | McCarten et al. | 122/136 R |
| 1,697,015 | 1/1929 | Majuga | 122/136 R |
| 1,974,001 | 9/1934 | Vallero | 122/136 R |
| 3,192,906 | 7/1965 | Gerbert | 122/136 R |

FOREIGN PATENT DOCUMENTS

| | | | |
|---|---|---|---|
| 100863 | 5/1937 | Australia | 122/136 R |

*Primary Examiner*—Edward G. Favors

[57] ABSTRACT

This invention relates to a novel liquid heater and more particulary to a water heater having a crescent-shaped heat receiving heat exchanger and element therefor.

4 Claims, 12 Drawing Figures

CRESCENT HEAT EXCHANGER LIQUID HEATER

Conventional water heaters are of tubular construction wherein either the water surrounds the tubes containing the hot combustion gases or wherein the water is within the tubes and the hot combustion gases surround these tubes.

It is an object of this invention to provide a novel liquid heater having a novel combustion chamber and a novel crescent-shaped heat receiving element.

Figure 1:
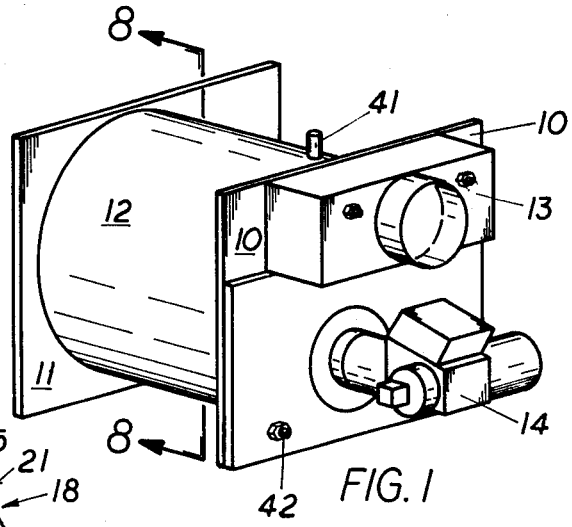
Figure 2:
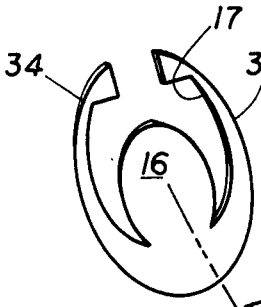
Figure 3:
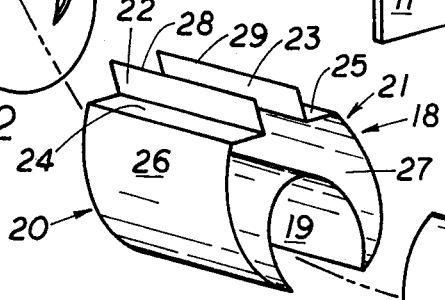
Figure 4:
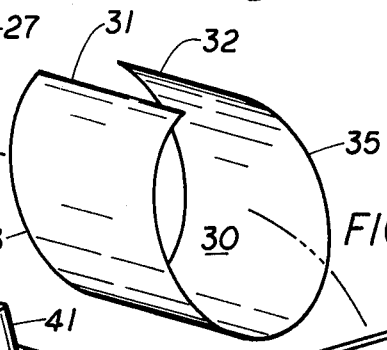
Figure 7:
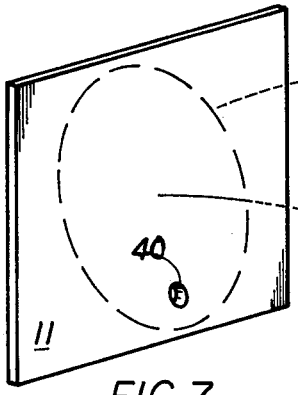
Figure 6:
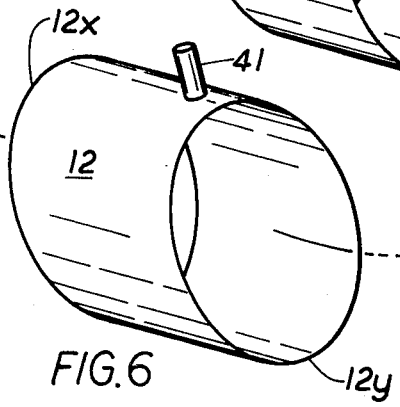
Figure 5:
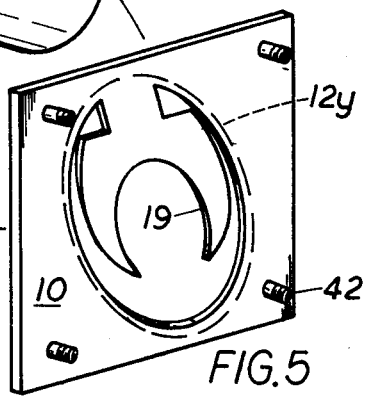
Figure 8:
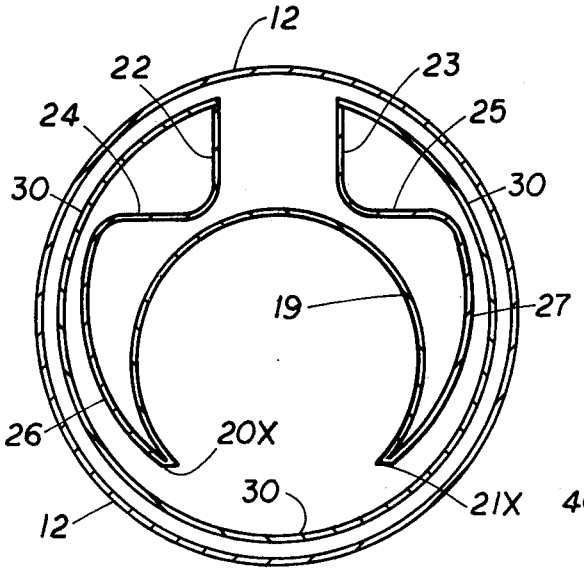
Figure 9:
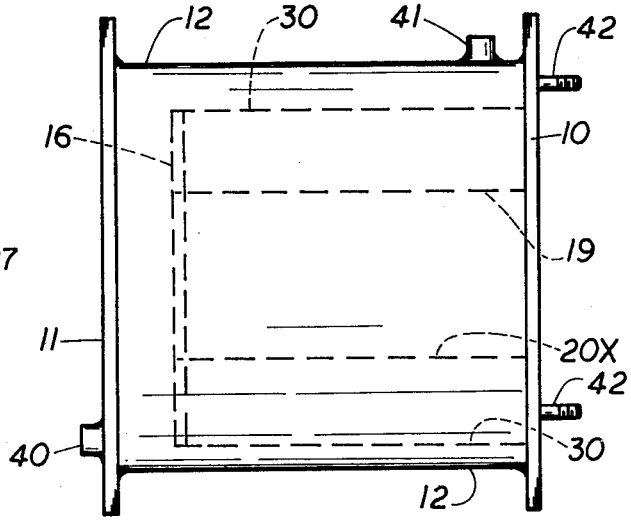
Figure 10:
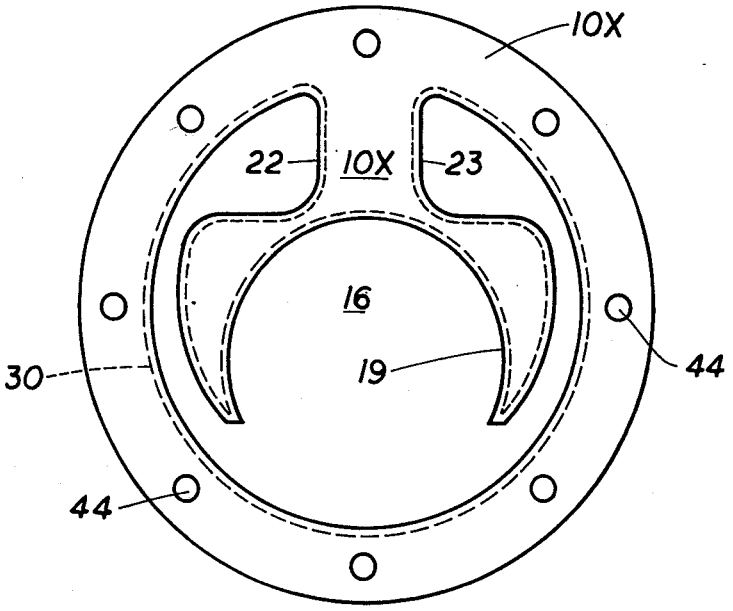
Figure 11:
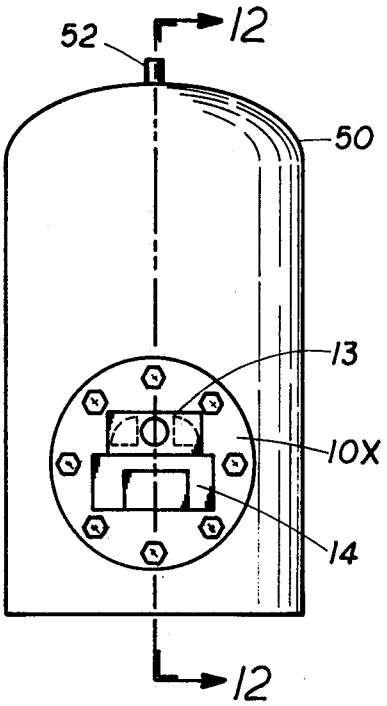
Figure 12:
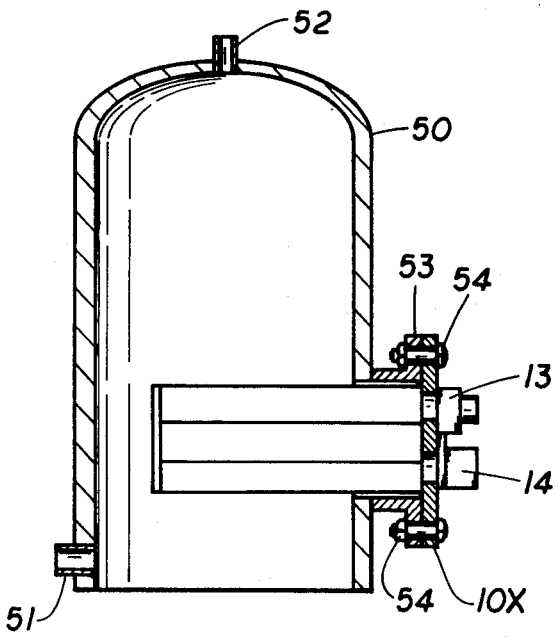

This and other objects will become apparent upon reading the following descriptive disclosure of an illustrative embodiment showing in the accompanying drawing in which, FIG. 1 is a perspective view of the assembled water heater showing a front heater plate having a gas or oil fuel feed mechanism on the bottom thereof and showing further an exhaust box for the removal of the combustion gases on the top thereof, FIG. 2 through FIG. 7 display in schematic formation the various elements used to form the assembled heater, FIG. 2 is a view of the inner rear heat exchanger plate made from metal and showing a crescent-shaped area removed therefrom, FIG. 3 is a view of a co-acting tubular-or trough-like heater element adapted to be welded to the inner rear heat exchanger plate of FIG. 2, FIG. 4 is a view of the internal heat exchanger cylindrical shell adapted to be welded to the crescent-shaped trough-like element of FIG. 3, FIG. 5 is a view of the front heater plate and showing the crescent-shaped portion adapted to be welded to the trough element of FIG. 3 and further showing bolts for securing an outer exhaust box and also an outer fuel mechanism thereto, FIG. 6 is a view of the external cylinder shell and showing a top outlet pipe for the heated liquid, FIG. 7 is a view of the rear heater plate in rectangular form in order to function also as a support for a horizontally disposed heater (FIG. 1) and further showing an inlet orifice for fluid inlet, FIG. 8 is a front cross section view of the heat exchanger taken on line 8—8 of FIG. 1, FIG. 9 is a side view of the assembled heater of FIG. 1 and showing in dotted outline the novel heat exchanger of this invention therein, FIG. 10 is a front view of a modified heater showing a circular front plate adapted to be removably secured, for example, to the vertically disposed tank shown herein, FIG. 11 is a front view of a vertically disposed tank having the assembly of FIG. 10 secured thereto and FIG. 12 is a section view taken on line 12—12 of FIG. 11.

As a statement of this invention, the inventive concept relates to a novel heat exchanger disposed in the configuration of a crescent-shaped element having a trough or channel therein for heating the fluid and wherein the flame is disposed within the crescent configuration for absorption of maximum heat from a radiant flame. In this invention there is no tube confined fluid being heated. Rather a trough confined fluid is heated.

Turning now to the drawing and to FIG. 1 in particular, there is shown a front heater plate 10 that also functions as a support element for a horizontally disposed heater. There is also provided a back support plate 11 and an external cylindrical shell 12. There is further provided a conventional exhaust box 13 for conducting exhaust combustion gases from the apparatus and a conventionally mounted and insulated burner unit 14 for producing a gas or an oil fired flame.

A critical feature of this invention, is the provision of a crescent-shaped heat exchanger wherein the flame is burned in a centrally located combustion compartment enveloped by a pair of elongated fluid or water conducting horns disposed in opposed relationship and wherein the combustion gases are conducted over the exterior surfaces of these horns to an exhaust port. Since the water being heated is under pressure, all the joints of the apparatus are preferably welded together.

Turning now to FIG. 2, there is shown the inner heat exchanger rear plate 16 having a crescent-shaped cutout portion removed along edge 17, thereby providing for the entrance of fluid into the trough formed.

FIG. 3 is the trough or channel containing element for conducting fluid exteriorly of the combustion compartment wall 19. The crescent-shaped element 18 is preferably made of one sheet of metal suitably formed. However, it may be made of several flat separate or several curved separate pieces of sheet metal suitably formed and thereafter welded together. Thus it may be made from a centrally disposed split cylindrical piece 19 and two opposed specially formed side wall 20 and 21 welded at weld joints 20X and 21X.

Side wall 20 is provided with a vertically disposed wall 22 and side wall 21 is provided with a corresponding parallel disposed wall 23. Thus walls 22 and 23 form a trough or channel for heating fluid by direct contact with metal-engaging hot gaseous convection currents.

Side wall 20 is further provided with a horizontally disposed wall 24 and side wall 21 is provided with a corresponding horizontal wall 25, thereby forming passageways for the removal of combustion gases flowing around said walls 20 and 21.

Moreover, side wall 20 is provided with a cylindrical area 26 and side wall 21 is provided with a similar cylindrical area 27. These side walls 20 and 21 expose a large area to combustion gases on one side and to fluid being heated on the other side, by the movement of the gases from the flame to the exhaust box 13.

Furthermore, the side walls 20 and 21 are suitably disposed to cylinder wall 30 to effect an efficient extraction of heat.

The wall 22 is provided with an edge 28 and wall 23 with an edge 29 which are respectively welded to edges 31 and 32 of shell 30. The interior surface of shell 30 forms part of the heat exchanger surface.

This invention can be viewed as comprising two separate interconnecting chambers, namely a radiant heat chamber and a convection gas heated chamber.

The shell 30 is welded at its edge 33 to edge 34 of the inner rear plate 16 and the front edge 35 of shell 30 is welded to the front plate 10.

As shown in FIG. 9, the rear plate 11 is provided with a fluid orifice 40 and the shell 12 with an outlet pipe 41 for the heated fluid. Also the front heat exchanger plate 10 is provided with bolts 42 for securing the burner unit 14 and also the exhaust box 13.

FIGS. 10 to 12 show the manner of disposing the heat exchanger apparatus of this invention into any tank, for example, the vertically disposed tank 50. In this modification of the invention, the front plate 10X is circular and is provided with a plurality of bolt receiving apertures 44. Also the tank 50 is provided with an inlet orifice 51 and an outlet orifice 52.

The crescent-shaped heat exchanger assembly is inserted into a suitably large opening in tank 50 about which is welded an apertured flanged ring 52. The apertures 44 of plate 10X are spaced to mate with apertures in the ring 53. Conventional bolt and nuts 54 are used to secure elements 53 and 10X together with the aid of a sealing gasket or sealing compound.

An exhaust assembly unit 13 and a burner assembly 14 may be secured to the heat exchanger front plate 10X by bolts or other conventional means.

This invention has been described by means of a plurality of embodiments but it is not restricted to these examples for it is of a basic scope. Thus, for example, the exhaust gases in the exit passage confined between the illustrated vertical and co-acting horizontal walls, may be confined in a continuously curved wall in place of the illustrated vertical and horizontal walls.

Also the walls 26 and 27 may be made of a plurality of flat segments in place of the continuous wall shown. Moreover, this invention covers all types of tanks including vertical, horizontal and inclined tanks.

I claim:

1. A liquid heating heat exchanger assembly comprising an elongated cold liquid trough element having a substantially crescent-shaped cross-section; an inner back plate having a co-acting crescent-shaped cut-out portion, hermetically secured to the back of said trough element; and a front plate having an opening therein having a depending crescent section, said section being sealed hermetically to the front edges of said trough element, whereby inlet cold fluid is conducted through and around said assembly while being heated.

2. The apparatus of claim 1, wherein the crescent-shaped trough element is provided with co-acting opposed side walls, each wall having a cylindrical wall portion, an intermediate horizontal wall portion and a vertical wall portion, whereby a trough-channel for inlet fluid is formed interiorly of the opposed trough wall and whereby further a pair of exhaust combustion gas passageways are formed exteriorly of said opposed trough walls.

3. The device of claim 1 comprising a horizontally disposed tank having a rectangular front plate having a dual function of being the front fluid confining plate of said crescent-shaped apparatus and further functioning as the front support for said tank; a rear rectangular tank support plate having a fluid inlet orifice and co-acting with said front rectangular plate to support said tank; and a tank fluid-confining shell disposed hermetically between said front and said rear rectangular plates, said shell enveloping said combustion chamber apparatus in spaced relationship and having an outlet orifice for heated fluid.

4. The device of claim 1 comprising a vertical tank disposed around said assembly and having a water inlet and hot water outlet; and means for securing removably said assembly to said tank.

* * * * *